US008286541B2

(12) United States Patent
Lorenzut

(10) Patent No.: US 8,286,541 B2
(45) Date of Patent: Oct. 16, 2012

(54) FIREARM WITH ENHANCED HANDLING BY DISSIPATING THE EFFECTS OF RECOIL AND MUZZLE CLIMB

(76) Inventor: Sylvio Richard Lorenzut, Lagrangeville, NY (US)

( * ) Notice: Subject to any disclaimer, the term of this patent is extended or adjusted under 35 U.S.C. 154(b) by 0 days.

(21) Appl. No.: 12/817,824

(22) Filed: Jun. 17, 2010

(65) Prior Publication Data

US 2011/0088304 A1 Apr. 21, 2011

Related U.S. Application Data

(60) Provisional application No. 61/187,850, filed on Jun. 17, 2009.

(51) Int. Cl.
*F41A 3/38* (2006.01)

(52) U.S. Cl. ..... 89/190; 89/189

(58) Field of Classification Search ..... 89/187.01, 89/189, 190, 173, 175, 176
See application file for complete search history.

(56) References Cited

U.S. PATENT DOCUMENTS

| | | | | |
|---|---|---|---|---|
| 3,901,125 | A * | 8/1975 | Raville | 89/163 |
| 4,127,056 | A * | 11/1978 | Kart | 89/128 |
| 4,594,935 | A | 6/1986 | Smith | |
| 5,347,912 | A | 9/1994 | Gathoye | |
| 5,669,169 | A | 9/1997 | Schmitter et al. | |
| 6,286,241 | B1 | 9/2001 | Constant et al. | |

* cited by examiner

*Primary Examiner* — Stephen M Johnson
(74) *Attorney, Agent, or Firm* — Hiscock & Barclay, LLP

(57) ABSTRACT

A firearm having reduced recoil including a front slide connected to a rear slide by way of a slide link. Firing the firearm causes the rear slide to recoil and transfer energy, by means of the slide link, to the front slide. The front slide moving in the direction opposite the rear slide thereby reducing the recoil of the firearm. After reaching full recoil, the front and rear slides return to their resting positions.

16 Claims, 18 Drawing Sheets

FIREARM WITH ENHANCED HANDLING BY DISSIPATING THE EFFECTS OF RECOIL AND MUZZLE CLIMB

CROSS-REFERENCE TO RELATED APPLICATIONS

This application claims priority from U.S. Provisional Patent Application Ser. No. 61/187,850, filed Jun. 17, 2009, the contents of which are hereby incorporated in their entirety by reference.

FIELD OF THE INVENTION

This invention relates to a firearm having a reduction in recoil and muzzle climb. In another embodiment the invention relates to a firearm having two slide mechanisms that recoil in substantially opposite directions.

BACKGROUND OF THE INVENTION

Excessive recoil can cause discomfort and flinching upon subsequent shots. Additionally, the recoil can cause muzzle climb resulting in more difficult sight realignment. Conventional handguns utilize a one piece slide which travels rearward, sending the momentum of the recoil force rearward. This momentum is generated after firing of a round. The slide is carried rearward the full distance needed to extract and eject spent casings and to chamber a fresh round from the magazine. Thus all of the recoil generated by movement of the slide is transferred into the web of the users hand. This movement and weight transfer above and to the rear of the hand, combined with the effect of the projectile exiting the barrel at about the same time, causes the muzzle end of the firearm to rise dramatically. This is known as muzzle climb, and requires the user to readjust the firearm for subsequent shots.

Referring to FIGS. 1A-1C there is shown a handgun according to the prior art. The handgun 10 has a handle portion 11 a slide 12 and muzzle 13. Upon firing the handgun 10 a projectile leaves the muzzle 13. The recoil results in the slide 12 moving backwards away from the direction of the projectile. The weight of the slide 12, and the force caused by firing the projectile, results in a recoil force. The user of the handgun must absorb this force. The larger caliber round that the handgun fires, the larger the recoil force becomes.

In addition to generating recoil the handgun muzzle also tends to climb after the firing of a projectile. The recoil generates some rotation around the contact point between the users hand and the grip. This action causes the muzzle to climb. As the slide moves backwards, the handgun rotates around the contact point and cause the muzzle to climb. If another projectile is fired without first correcting for this muzzle climb the second projectile would be fired above the first. This is especially problematic in semi-automatic or automatic handguns where accuracy can be greatly reduced in rapid fire situations. Furthermore, the more powerful the round the more pronounced the recoil and muzzle climb. Muzzle climb makes reacquiring the sights into the target more difficult.

Existing methods to reduce recoil and muzzle climb include barrel porting, muzzle brakes or compressors. All of which have failed to adequately reduce recoil and muzzle climb to acceptable levels.

Therefore, a handgun having reduced recoil is desired.

Further, a handgun having reduced muzzle climb is desired.

SUMMARY OF THE INVENTION

The invention comprises, in one form thereof, a handgun having two slides. A rear slide that upon firing of a projectile moves backwards, and a front slide that upon firing of a projectile moves forwards.

More particularly, the invention includes a slide link that connects the front and rear slides. The slide link allows for a portion of the force applied to the rear slide to be transferred to the front slide thereby reducing recoil of the firearm.

The handgun allows for a shorter overall length due to the dual slide mechanism. Furthermore the reduced recoil reduces shooting fatigue during repeated use.

In another form, the invention includes a slot drive to allow portion of the force applied to the rear slide to be transferred to the front slide thereby reducing recoil of the firearm.

An advantage of the present invention is that the oppositely acting slides provide a significant reduction in recoil and muzzle climb.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1A:
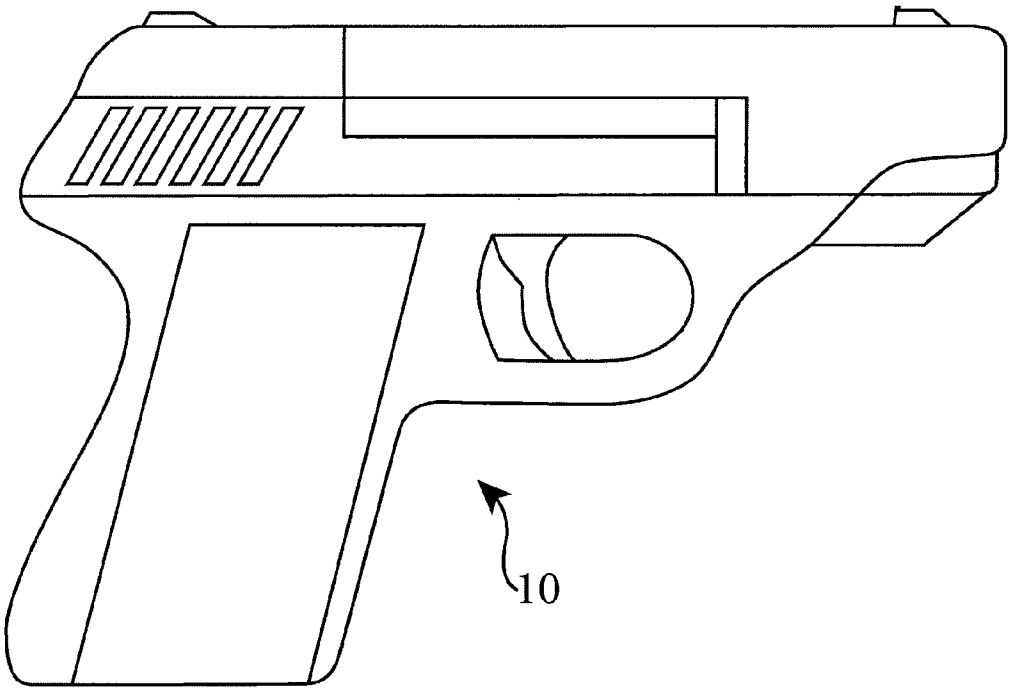
Fig. 1A PRIOR ART
FIG. 1A is a schematic view of a conventional handgun according to the prior art.
Figure 1B:
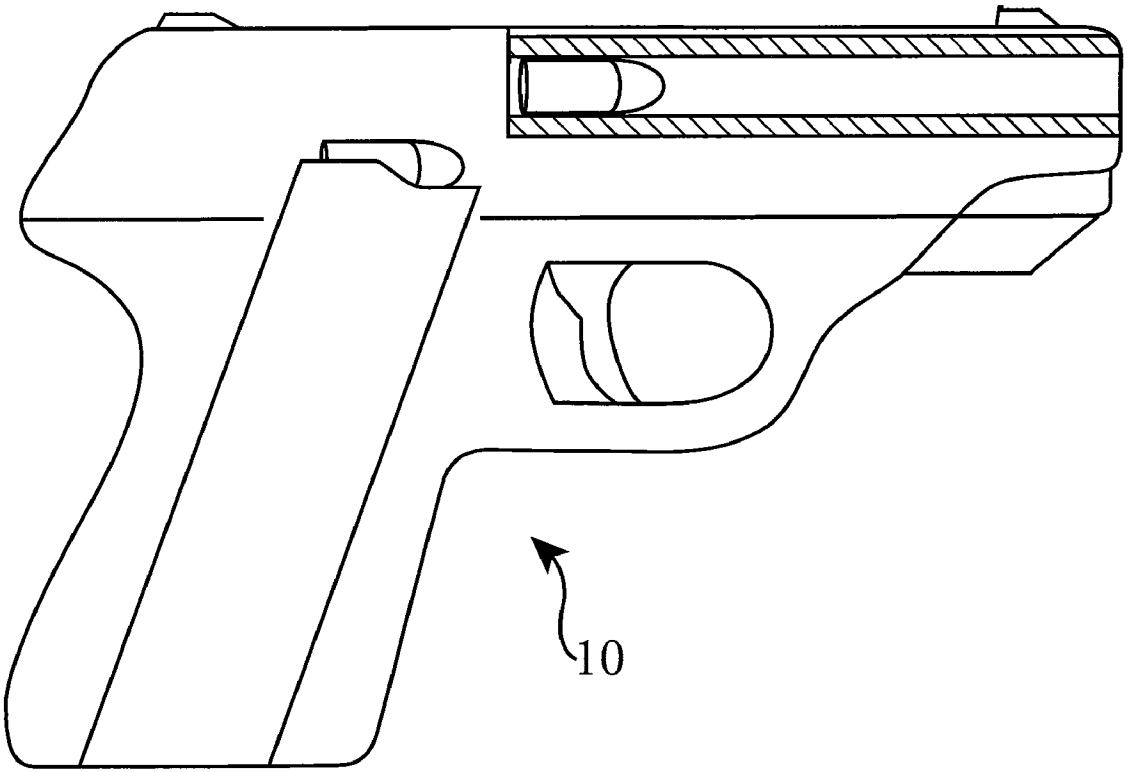
Fig. 1B PRIOR ART
FIG. 1B is a schematic view of a conventional handgun having a round in the chamber according to the prior art.
Figure 1C:
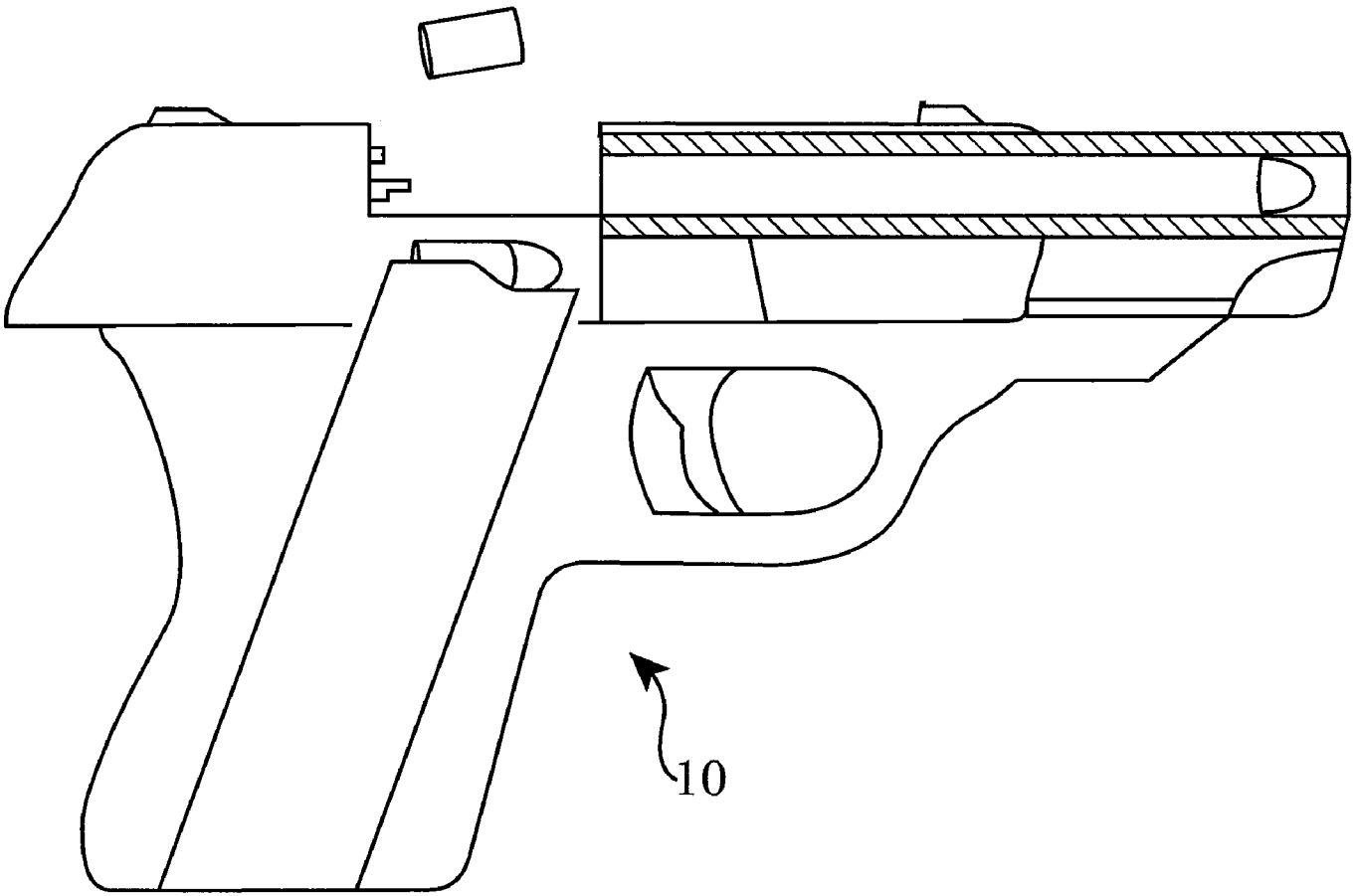
Fig. 1C PRIOR ART
FIG. 1C is a schematic view of a conventional handgun in full recoil according to the prior art.
Figure 2A:
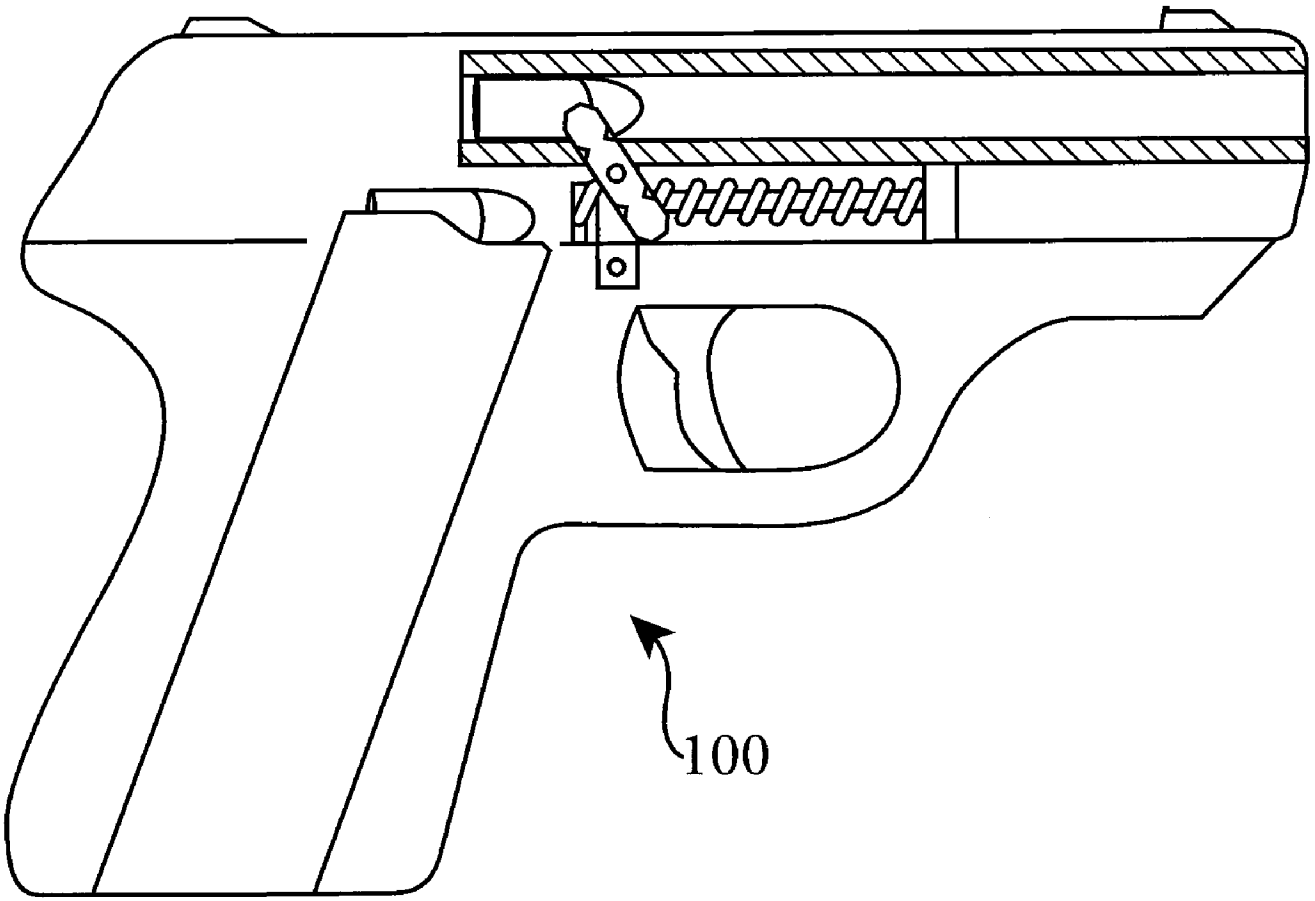
FIG. 2A is a schematic view of a handgun having a round in the chamber ready to fire according to one embodiment.
Figure 2B:
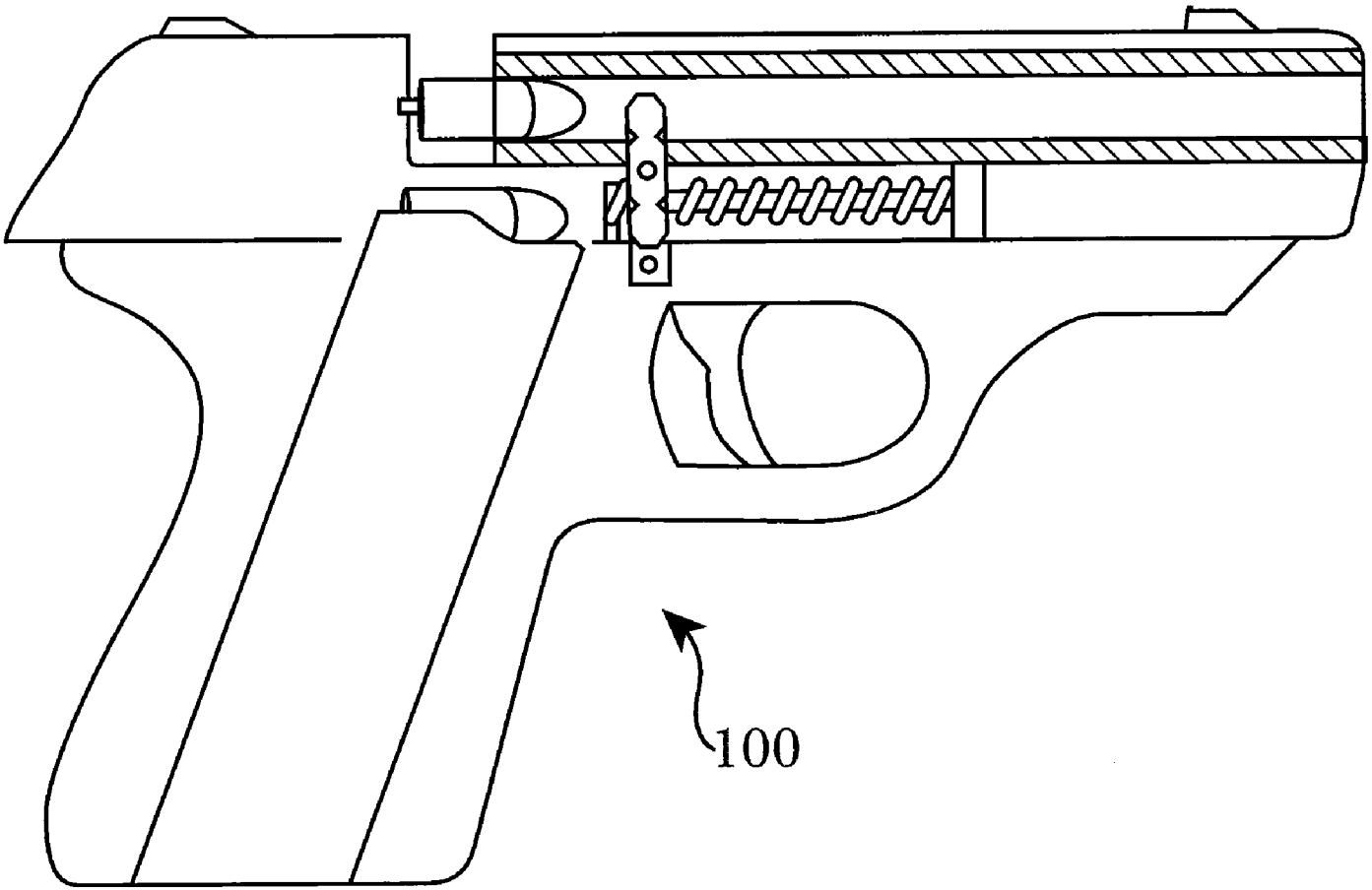
FIG. 2B is a schematic view of the handgun shown in FIG. 2A in full recoil.
Figure 2C:
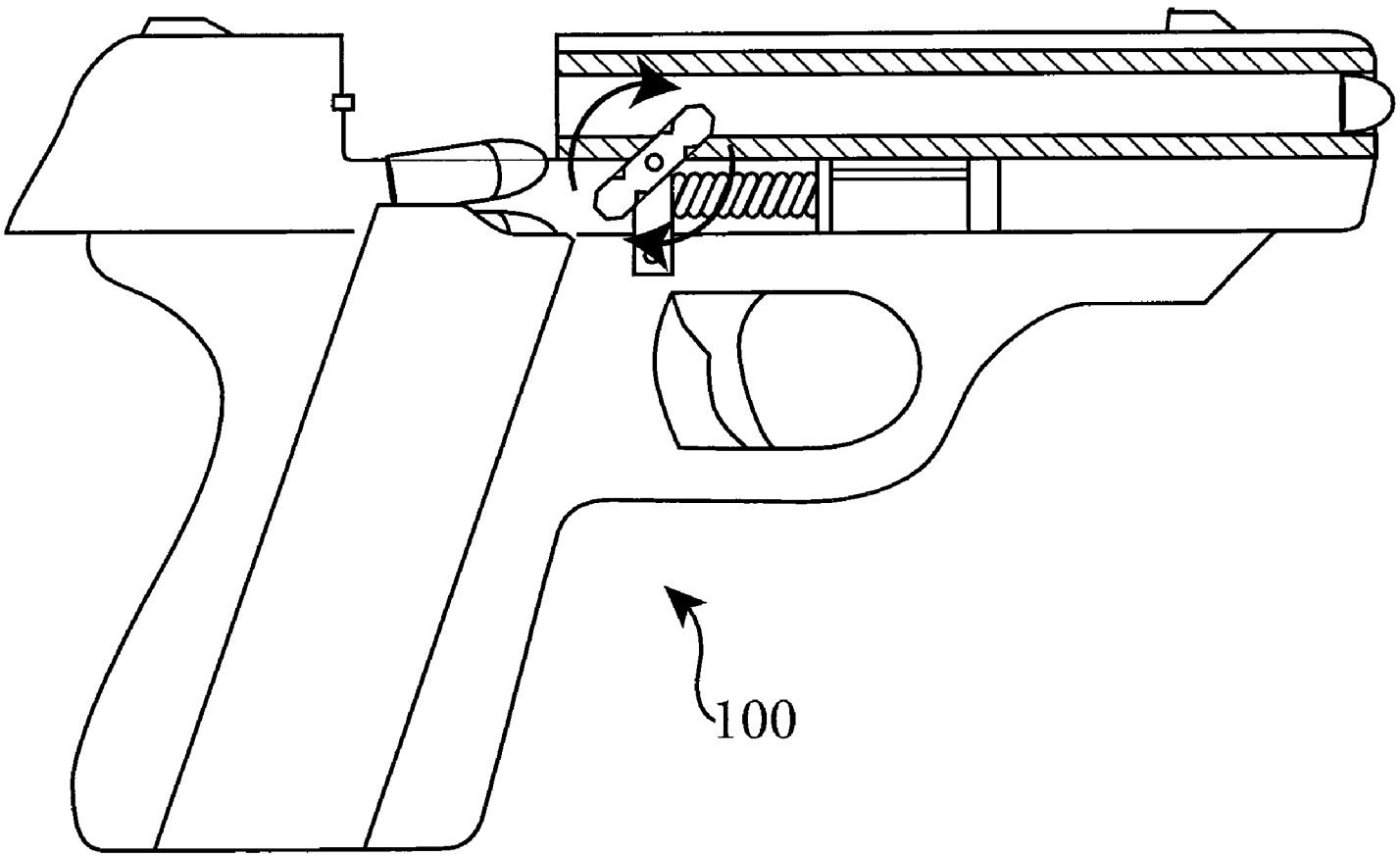
FIG. 2C is a schematic view of the handgun shown in FIG. 2A with a new round chambering.

Referring to FIGS. 2A-2C, there is shown the firearm of the present invention according to one embodiment. The handgun 100 includes a frame 101 a front slide 120 and a rear slide 130. As shown in FIG. 2A, the handgun 100 has a round in the chamber and is ready to fire. The front slide 120 and rear slide 130 are in communication with each other and the chamber is sealed.

Referring now to FIG. 2B, once the trigger has been pulled and the round fired, the handgun 100 reaches full recoil. The force generated by discharging the round causes the back slide to move rearward, away from the direction the round is fired. A slide arm mount 150 connects the rear slide and front slide together. The rear slide 130 pulls back the lower portion of the slide link, thereby causing the forward portion to push the front slide 120 forward. It is understood that the slide link could be modified in any manner such as to the front slide and rear slide to recoil in opposing directions.

The recoil force of the rear slide is mitigate by the recoil of the front slide. The total recoil felt by the user is thus reduced when compared to a traditional firearm having only a rear slide. Because both the front and rear slides move, the recoil distance for the slide is reduced. With a single slide mechanism, that single slide must travel the full distance required for the casing to clear the chamber. With the dual slide system, the travel required for the rear slide is reduced as the front slide moves forward, thereby creating the same opening as a single slide mechanism with a reduced recoil distance. Furthermore, as the front slide travels forward, the added weight over the front end of the barrel reduces the effects of muzzle climb after a round is fired.

Figure 9:
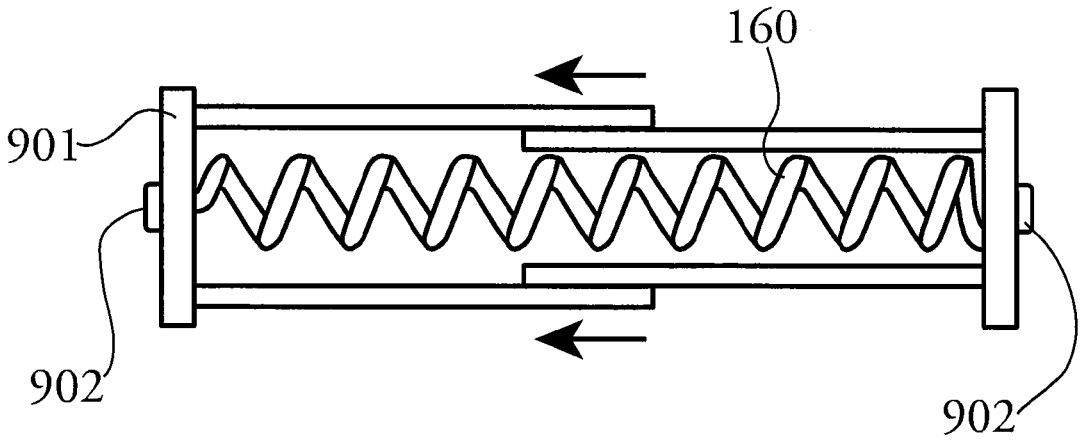
FIG. 9 is a schematic view of a recoil spring and recoil spring housing according to one embodiment.

During recoil the slides compress the recoil spring 160. After reaching full recoil, the recoil spring 160 expands and begins the counter recoil process to return the slides to their original resting position as shown in FIG. 2A. In one embodiment the recoil spring 106 is housed in a recoil spring housing 901 as shown in FIG. 9. The recoil spring housing having a set of housing studs 902 to properly set the recoil spring housing 901 between the slides (not shown). This embodiment exemplifies the use of a recoil spring to initiate the counter recoil, however it is understood that any suitable device could be used to return the slides to their resting position.

As the slides return to their resting position, the extractor 134 pulls the empty casing out of the chamber 142. The empty casing then strikes the ejector 102 which ejects the empty casing. While the extractor and ejector shown in this embodiment demonstrate an effective means for ejecting an empty casing, those skilled in the art will understand that any suitable substitute could be made to eject the empty casing. In one embodiment the ejector is a fixe ejector. In another embodiment the ejector is a retracting ejector.

In one embodiment, a magazine 110 is inserted into the magazine well 111 of the frame 101. A round from the magazine 110 is pushed into the chamber 142. Upon firing the round, the empty round casing is ejected and a fresh round is fed into the chamber from the magazine 110. The magazine 110 contains a magazine follower 112 and magazine spring 113. The magazine spring 113 is compressed when the magazine 110 is loaded. Upon the ejecting of a spent casing, the spring uncompresses and pushes the magazine follower 112, and each round in the magazine up towards the chamber 142. Upon the firing of the last round, the magazine follower 112 locks the slides in the open position. In one embodiment, the magazine follower 112 pushes up against the slide stop 107 to lock the front slide 120 and the rear slide 130 in the open position, indicating to the user that the last round in the magazine has been fired. In one embodiment the slide stop 107 is lever with a shaft, the shaft going through a hole in the frame above the trigger 105, and optionally through a hole in the slide arm mount 150. This shaft holds the frame 101 and the front slide 120 and rear slide 130 together.

The frame 101 is composed of steel, alloy or composite. Optionally, the frame 101 includes a safety 103 mounted to the safety hole 104 to prevent engagement of the trigger 105. For additional safety precautions the frame 101 also includes a trigger guard 109 to prevent accidental contact with the trigger 105. It is understood that distinct or additional safety mechanisms may be included without detracting from the invention. In one embodiment the frame is about 150 mm long, 80 mm high and 30-34 mm wide.

It is understood that the dimensions given herein this application are for demonstrative purposes only and should not be construed as limiting. The dimensions set forth relate to a .380 ACP, however such dimensions may be modified to optimize characteristics of the firearm or user preferences. The dimensions may be further modified to accommodate use with other caliber firearms.

In one embodiment, the top portion of the frame 101 includes frame rails 106 for attachment of the front slide 120 and the rear slide 130. The front slide rails 121 and the rear slide rails 131 are designed to mate with the frame rails 106 of the frame 101. This allows movement of the front slide 120 and rear slide 130. Optionally, the front slide 120 further includes front guide rails 129 for attachment to the upper guide rails 132 of the rear slide 130. This additional attachment provides more stable and reliable movement of the slides.

The front slide 120 is designed to travel forward along the frame rails 106 in the direction opposite the travel of the rear slide 130. Optionally, the front slide 120 includes a front recoil spring seat 123 and a front slide link insert 125 to attach slide arms 152. The front slide link insert 125 is designed to cradle the slide arms 152. The front slide 120 may be composed of steel, alloy or composite. In one embodiment the front slide includes a barrel that is integrated into the slide 120. In another embodiment, the barrel 140 is a removable barrel. In one embodiment the front slide is 100 mm long, 30 mm wide and 30 mm high.

The rear slide 130 is designed to travel rearward along the frame rails 106 in the direction opposite the travel of the front slide 120. Optionally, the rear slide includes a rear recoil spring seat 133 and a rear slide link insert 135 to attach slide arms 152. The rear slide link insert 135 being designed to cradle the slide arms 152. The rear slide 130 may be composed of steel, alloy or composite. The bottom edge of the rear slide 130 is machined to form the slide rails 131 which are designed to mate with the frame rails 106. In one embodiment the rear slide is 120 mm long, 30 mm wide and 30 mm high.

To optionally limit travel of the slides, limit studs are used to set a maximum. In one embodiment, the front slide 120 includes a guide rail stud 122. As the rear slide 130 moves reward and the front slide 120 moves forward the guide rail stud 122 limits the maximum travel by the slides by contacting the front wall 139 of the rear slide 130. It is understood by those skilled in the art that various mechanisms can be substituted for limit studs. Additionally, the limit stud my be located on the frame, the rear slide and/or the front slide to effectively limit travel of the slides.

In another embodiment, the recoil spring limits the maximum travel of the slides. Once the spring is fully compressed, the spring prevents further travel of the slides. In yet another embodiment the slide rails contain stops to limit the maximum travel of the slides.

The front slide 120 includes a barrel bore 124 to house the barrel 140. The barrel having a chamber 142 to house a round and a muzzle end 141. The barrel 140 is designed to house a live round, contain gas pressure upon ignition and impart a stabilizing spin on the projectile as it exits the muzzle end 141 of the barrel 140. The barrel 140 has a cylindrical bore throughout, sized to the appropriate caliber of the round. In one embodiment the barrel is a steel barrel. The size of the barrel will change depending on the caliber of the round to be fired. In one embodiment the barrel is between 85 and 100 mm long and about 14 mm in diameter.

Optionally to improve accuracy, a front sight 128 and a rear sight 138 are attached to the top surfaces of the front slide 120 and rear slide 130 respectively. The sights can be any design known to those skilled in the art. Additionally, the slide may include a mount for a scope or laser sight.

In one embodiment the barrel 140 is connected to the front slide 120 through the barrel bore 124 by inserting the barrel 140 into the front of the barrel bore 124. The barrel studs 143 on either side of the barrel 140 engage the barrel stud insert 127 of the front slide 120. Upon nearing full insertion, the barrel is rotated to allow the barrel studs 143 to engage the barrel stud insert 127 and lock the barrel in place. As the barrel 140 is rotated a spring loaded detent 126, so positioned in the bottom of the front slide 120, engages a corresponding notch 144 in the barrel 140. The spring loaded detent 126 locks the barrel 140 into the front slide 120 to prevent the barrel 140 from backing out. In one embodiment, the spring loaded detent is a plunger (not shown) that rides on a spring. The spring and plunger are located in a drilled hole in order to limit movement. The spring loaded detente can only be depressed in one direction, allowing a locking projection to pass by the detent. Once passed and the barrel is properly aligned, the detent extend locking the barrel in place. While a preferred embodiment for locking the barrel in place has been described, it is understood that additional methods for locking a barrel in place are known to those skilled in the art.

The front slide may optionally include a recoil chamber. In one embodiment, the recoil chamber includes a front recoil spring seat 123 to hold a recoil spring 160. When assembled, the recoil spring 160 provides resistance between the front slide 120 and the rear slide 130. As the slides travel away from one another, as shown in FIG. 2B, the recoil spring 160 is compressed to store energy. The recoil spring 160 then elongates pushing the front slide 120 and the rear slide 130 back to their resting positions as shown in FIG. 2A. The recoil spring pushes against the front recoil spring seat 123 of the front slide 120 and the rear recoil spring seat 133 of the rear slide 130 to push the slides along the frame rail 106 back to their resting position. In one embodiment, the recoil spring is a helically coiled spring. In one embodiment the recoil spring is about 50 mm long. In another embodiment the recoil spring is an air spring. In yet another embodiment, the recoil spring is a dual stage spring to allow the user to more easily cock the firearm and to provide adequate recoil strength after discharge of the firearm. In a further embodiment, the recoil spring is a hydraulic piston. In yet a further embodiment, the recoil spring is a retainer spring. In one embodiment the recoil spring 160 passes through the spring hole 151 in the slide arm mount 150. While the recoil spring is shown connected above the slide assembly and between the front and rear spring seats it is understood that the recoil chamber is not limited to this position.

Figure 10A:
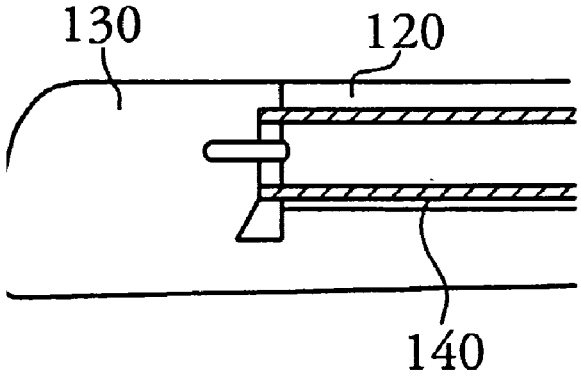
FIGS. 10A-10C are a schematic view showing the fitting of the two slides by use of a barrel recess according to one embodiment.
Figure 10B:
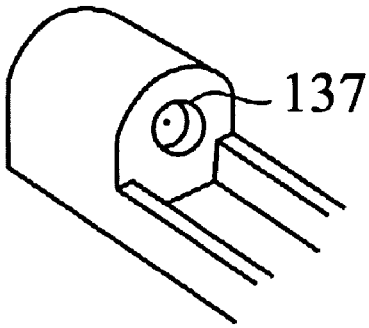
Figure 10C:
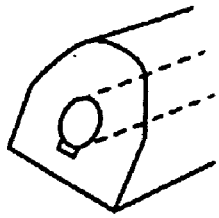

Referring to FIGS. 10A-10C there is shown the interface between the front slide 120 and the rear slide 130 according to one embodiment. The rear slide 130 contains a barrel recess 137 to fit the end of the barrel 140 which is affixed to the front slide 120. The barrel 160 creates a snug fit into the barrel recess 137 to create a sealed chamber.

Figure 3A:
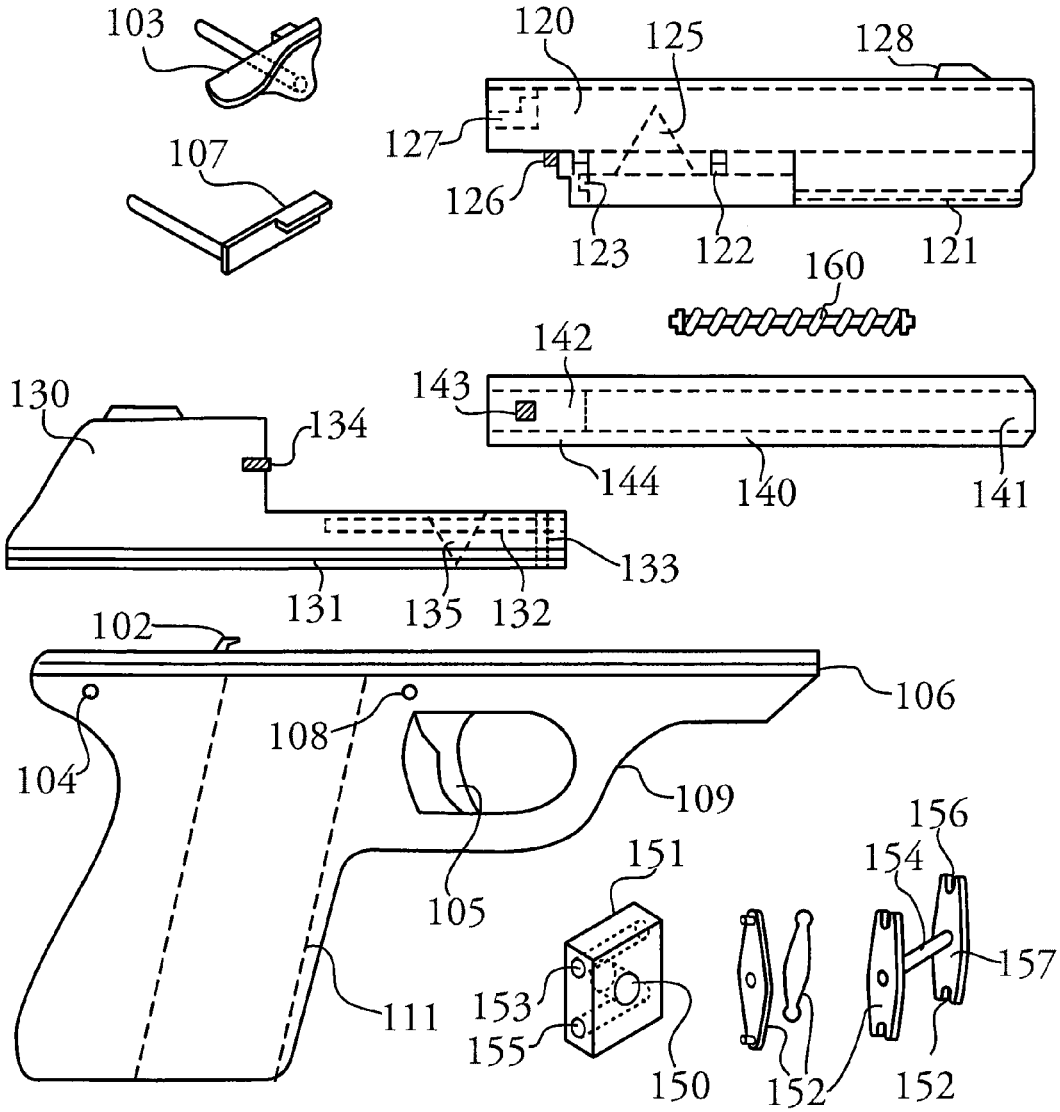
FIG. 3A is a exploded view of the handgun shown in FIGS. 2A-2C.
Figure 3B:
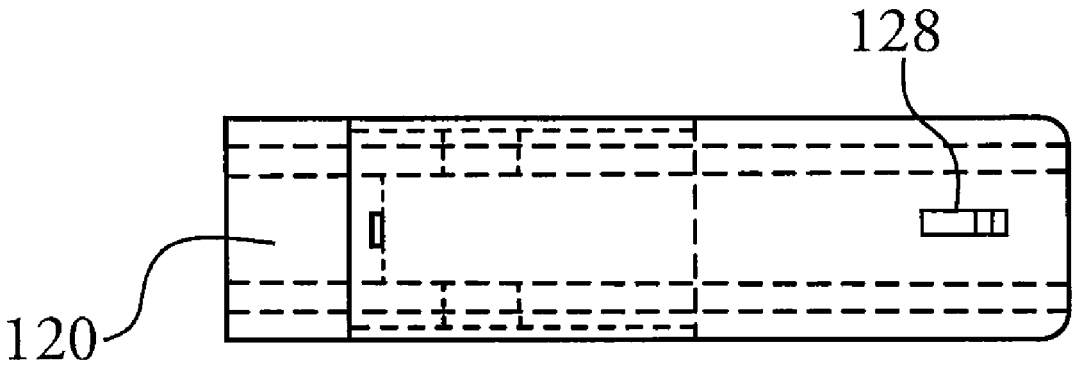
FIG. 3B is the top view of the front slide shown in FIG. 3A.
Figure 3C:
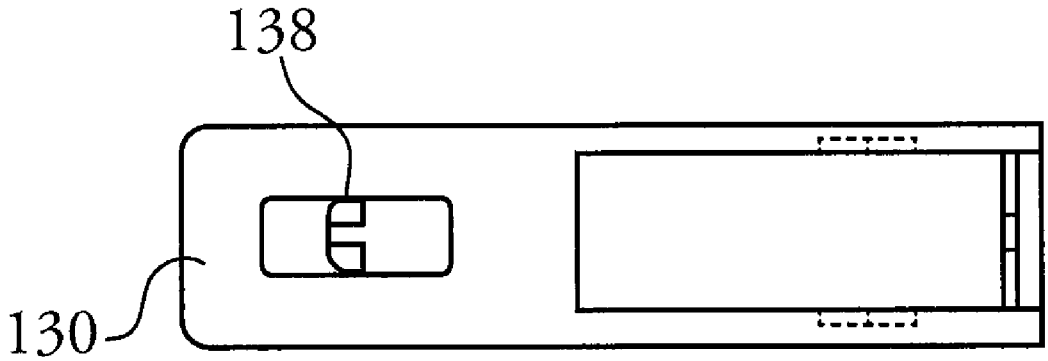
FIG. 3C is the top view of the rear slide shown in FIG. 3A.
Figure 4A:
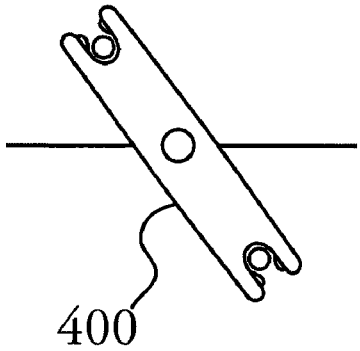
FIG. 4A is schematic view of a slide arm according to one embodiment.
Figure 4C:
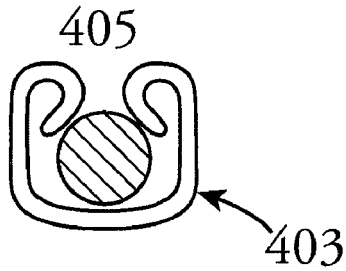
FIG. 4C is a schematic view of a retainer spring according to one embodiment.
Figure 4B:
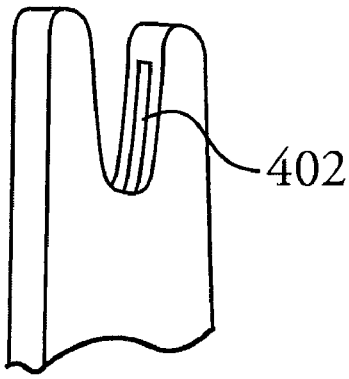
FIG. 4B is an expanded schematic view of the slide arm shown in FIG. 4A.
Figure 4D:
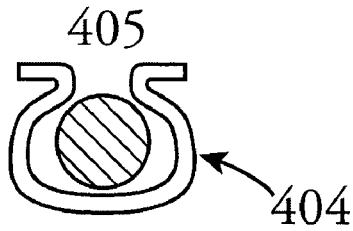
FIG. 4D is a schematic view of a retainer spring according to one embodiment.
Figure 4E:
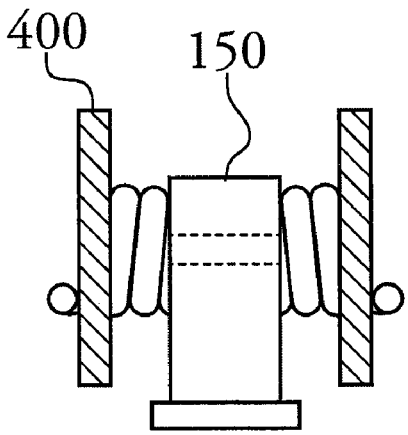
FIGS. 4E to 4H are illustrations of a slide arm and slide arm mount.
Figure 4F:
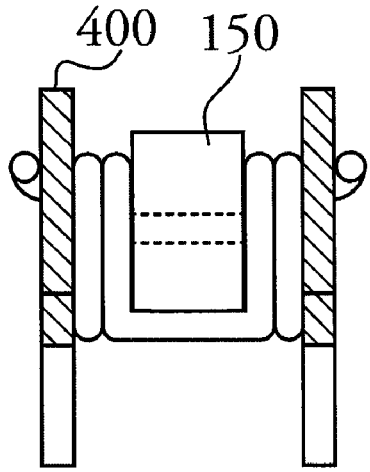
Figure 4G:
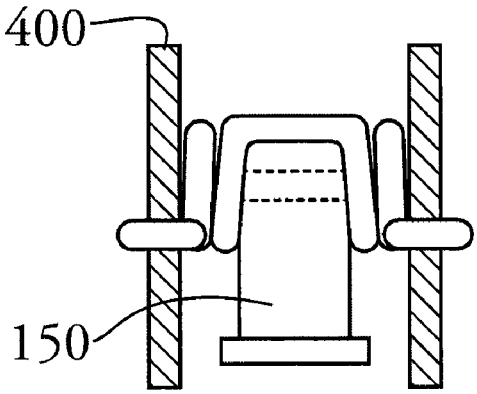
Figure 4H:
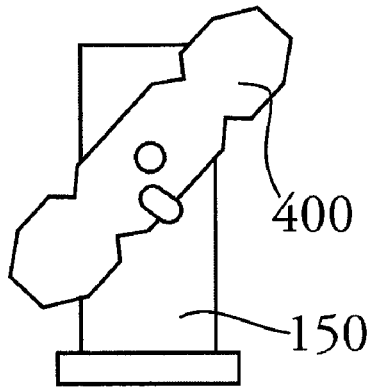

Referring to FIGS. 3A-3C, optionally, a slide arm mount 150 is attached to the frame 101. The slide arm mount 150 provides a static surface for which to mount a slide arm 152. In one embodiment, the slide arm mount is a part of the frame 101. In another embodiment, as shown in FIG. 3A, the slide arm mount is a removable mount. By utilizing a removable mount the firearm becomes field strippable. The slide arm mount 150 is secured to the frame between the front slide 120 and the rear slide 130 by placing a shaft through the cylindrical pivot bore 108 and the shaft hole 155. The slide arm mount 150 further has a slide arm hole 153 used to secure the slide arms 152. The slide arm pin 154 passes through the slide arm hole 153 to secure the slide arms 152 to the slide arm mount 150. It is understood that the slide arms may be a single slide arm, or as shown in FIG. 3A two slide arms. If to slide arms, they may move independently or be affixed together. In one embodiment the slide arm mount contains two holes bored at the top and bottom, one to secure the mount to the frame and the other to secure the slide arms. The slide arm mount should be constructed of a rugged material such as hardened steel to avoid deformation or breakage. In one embodiment, the slide arm mount is about 20 mm wide, 28 mm high and 10 mm thick.

Figure 5:
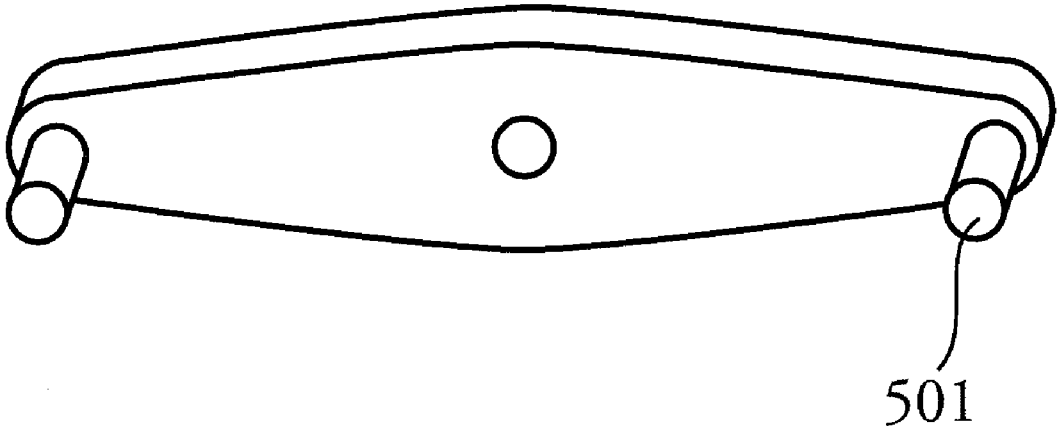
FIG. 5 is a schematic view of a slide arm having studs according to one embodiment.
Figure 6:
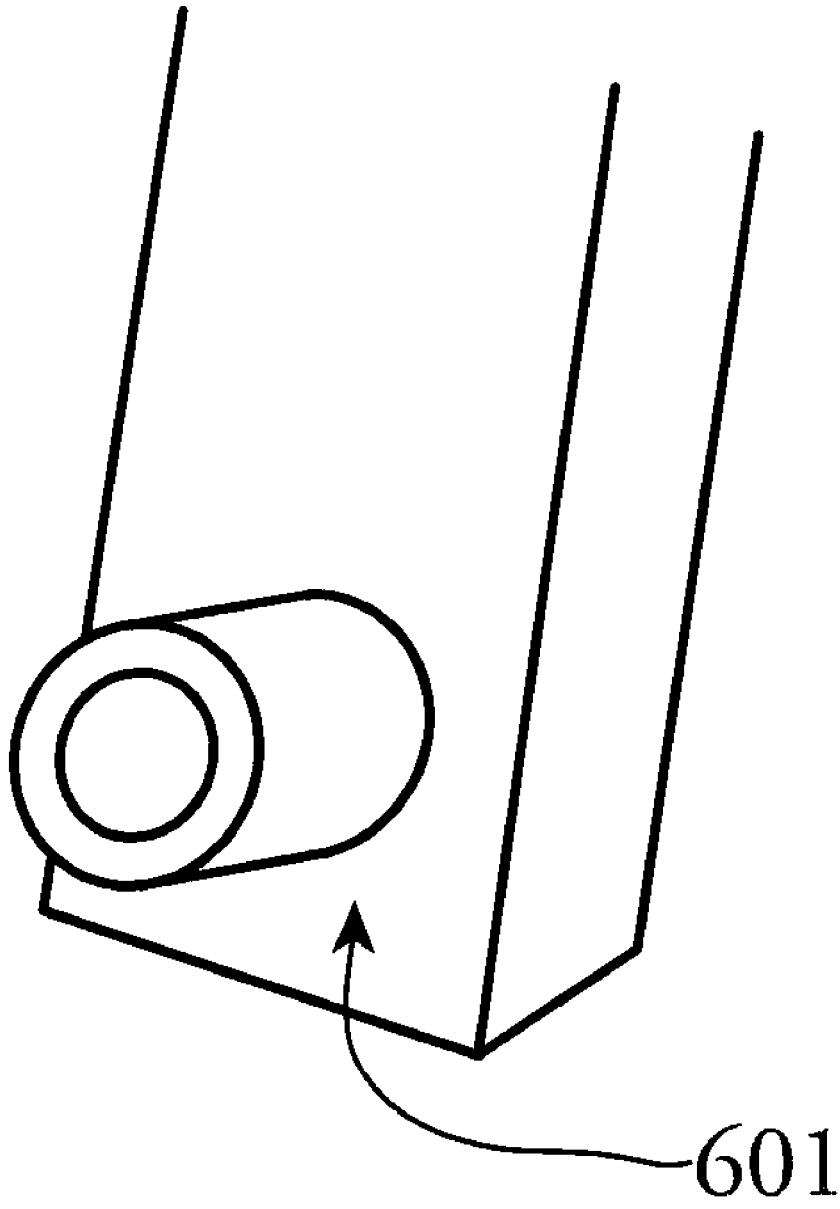
FIG. 6 is a schematic view of a slide arm having a bearing surface according to one embodiment.
Figure 7:
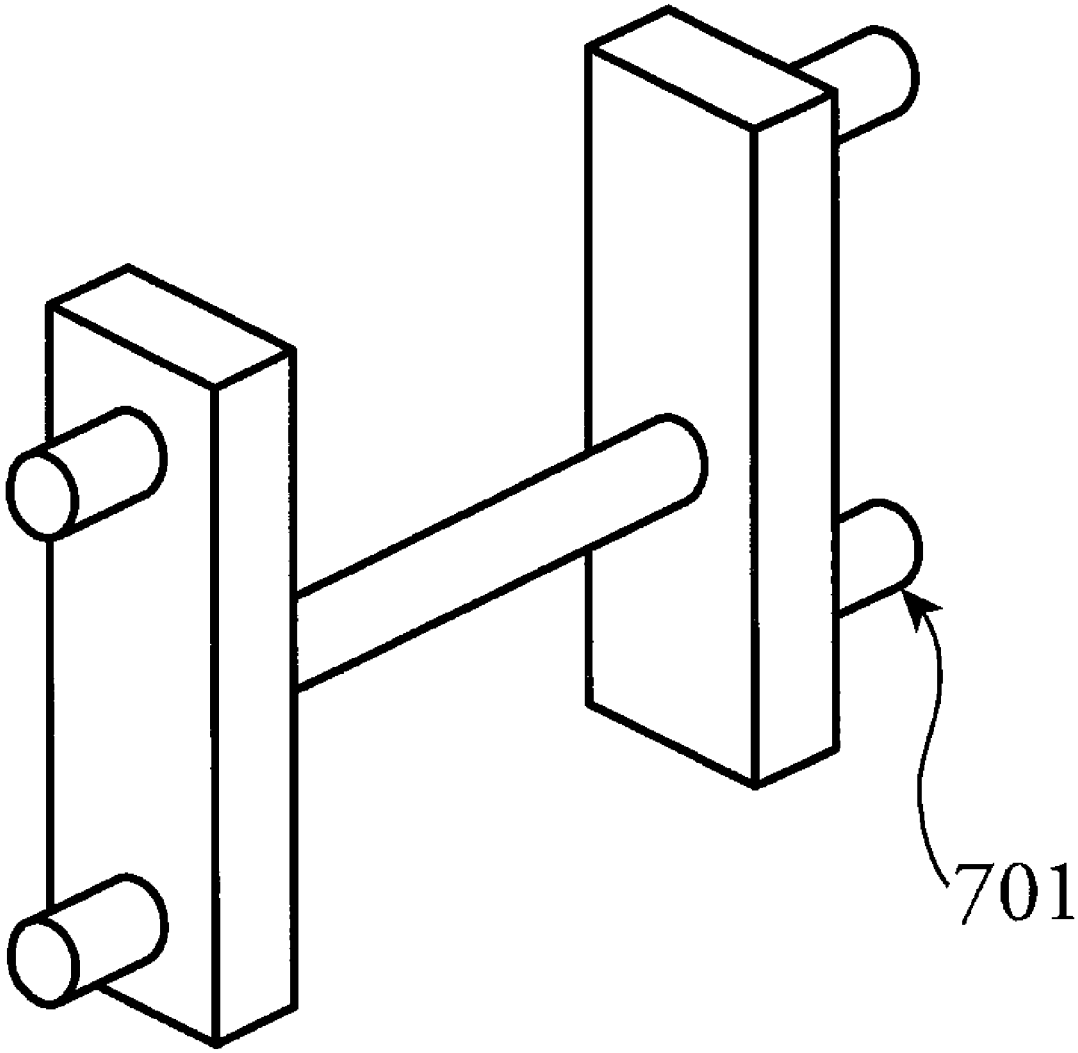
FIG. 7 is a schematic view of a slide arm having posts according to one embodiment.
Figure 8:
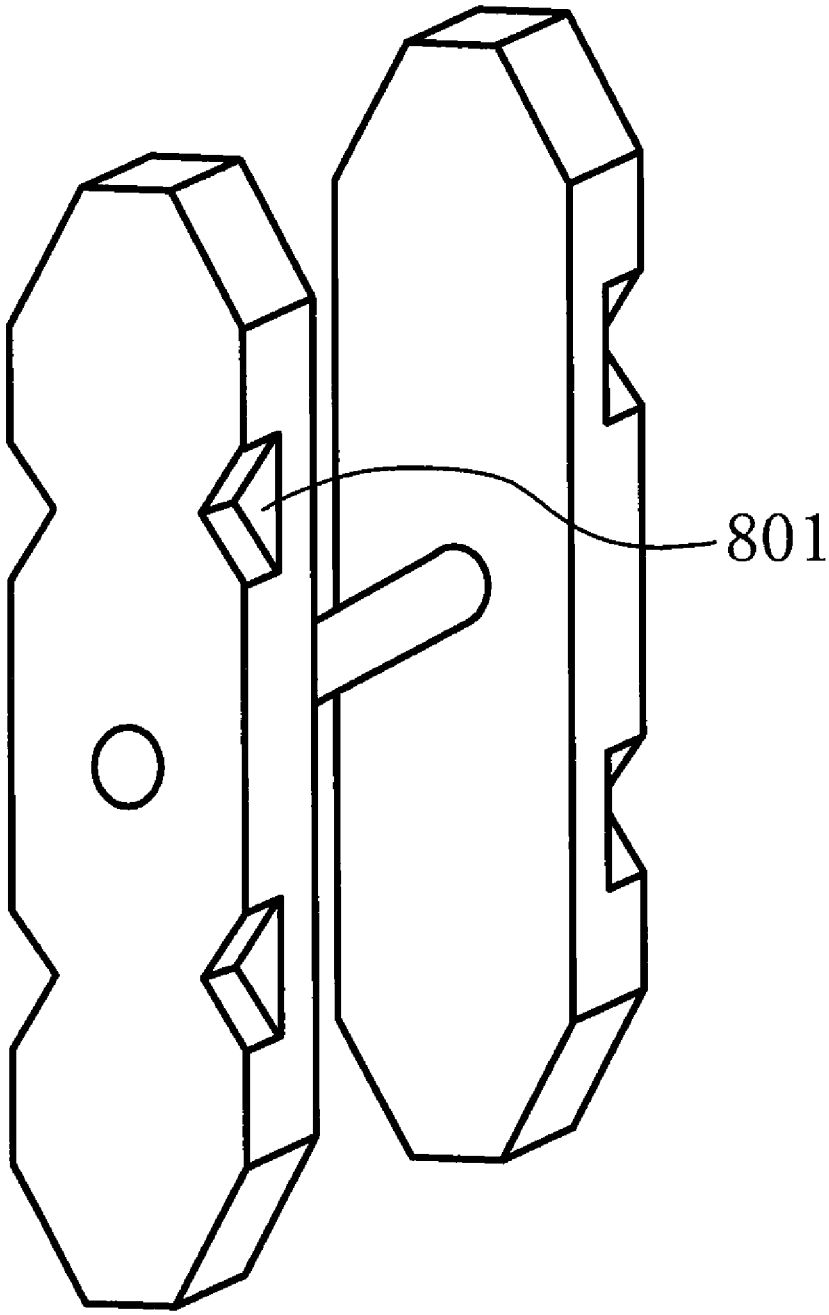
FIG. 8 is an isometric view of a slide arm having keyed transfer sections according to one embodiment.

The upper slide arm portion 156 is attached to the front slide link insert 125 on the front slide 120 and the lower slide arm portion 157 is attached to the rear slide link insert 135 on the lower slide 130. The slide arms may be attached to the slides by any suitable means, including but not limited to, pins, shafts and friction mounts. Referring to FIGS. 4A-4D there is shown a slide arm according to one embodiment and a spring retention. The slide arm 400 has a receiving end 401. The receiving end 401 has a retainer slot 402 to house a retainer spring. Any suitable retainer spring may be used, such as the retainer spring 403 and retainer spring 404. The retainer spring holds the stud 405 (attached to the slide) in place thereby affixing the slide to the slide arm 401. It is understood that reconfiguration of the slide arms from an open ended slot to a stud 501 projecting out from the arms to mate with slides as shown in FIG. 5 in contemplated. Additionally, the slide arms may be fitted with a bearing surface 601 as shown in FIG. 6 to roll against a surface of the slide. Further, the slide arms may have posts 701 as shown in FIG. 7 that fit into a detent or opening in the slides. Even further the slide arms may contain keyed transfer sections 801 as shown in FIG. 8 which correspond to cut sections of the slides. It is understood that these examples are demonstrative and are not intended to provide an exhaustive list of slide arm configurations to allow the transfer of recoil energy from the rear slide to the fronts slide.

In one embodiment the slide arms are attached to the slides by insertion into the slide link inserts at a 90 degree angle. Pushing the front slide forward allows interrupted guide rails on the outside of the front slide to drop through slots in the guide rails on the inside of the cradle arms to a lower track allowing the areas of overlap between the front and rear slides to interface smoothly during recoil. In one embodiment slide motion is restricted from overextension by the terminus of the guide rails at the front and rear in the event of slide arm failure.

Referring again to FIG. 3A, the slide arms 152 are designed to transfer a portion of the rear slide's 130 rearward motion into the forward motion of the front slide 120. The slide arms 152 rotate around the axis of the slide arm pin 154 which runs through the slide arm mount 150. As the rear slide 130 moves backwards it pulls the lower slide arm portion 157 backwards forcing the slide arms 152 to rotate along the axis of slide arm pin 154. The upper slide arm portion 156 moves forward pushing the front slide 120 forward as well.

The upper portion and lower portion of the slide arms can be configured with open slots at the ends, studs projecting outward, detents or holes to accept projections from the front or rear slide, or any other means to transfer momentum between the slides during the recoil process. In one embodiment the slide arms are 28 mm high and 5 mm wide. The slide arms should be constructed of a rugged material such as steel.

In one embodiment the handgun further includes a locking system to lock the slides together during cartridge ignition. For most low caliber rounds the force of the recoil spring is sufficient to seal the chamber during ignition. Furthermore, in some higher caliber rounds, the initial recoil force is sufficient to seal the chamber during ignition. However, for some rounds and designs a locking system is utilized to prevent gas leakage during ignition. Locking mechanisms are known to those skilled in the art of handguns having a slide mechanism.

Figure 11A:
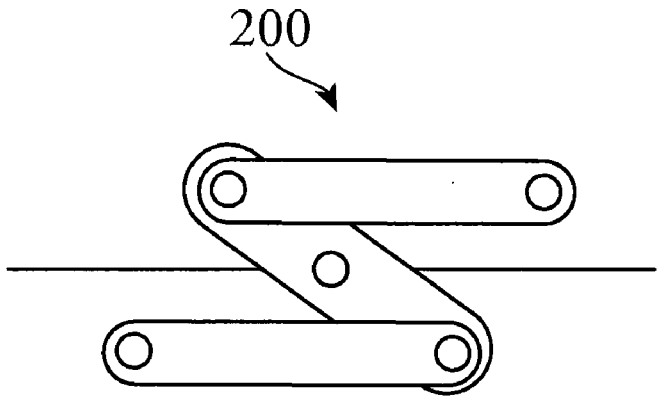
FIG. 11A is a schematic view of a slide arm extension at rest according to one embodiment.
Figure 11B:
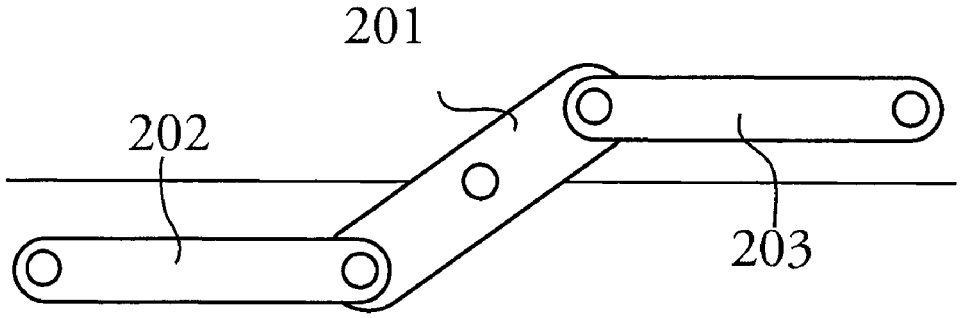
FIG. 11B is a schematic view of a slide arm extension at full recoil according to one embodiment.

While the slide transfer mechanism can be the slide arms as described above, it is understood that any suitable slide transfer mechanism can be used to transfer recoil energy from the rear slide to the front slide, thus allowing the two slides to move in opposing directions. Referring now to FIGS. 11A-11B there is shown an alternative embodiment of a slide transfer mechanism as a slide arm extension 200. The slide arm extension 200 has a center arm 201 affixed to the frame or a pivot mount (not shown), a rear slide arm 202 and a front slide arm 203 affixed to each of the slides. As a round is fired the rear slide pulls the rear slide arm 202 backwards (in the same direction as the rear slide) thus causing the center arm 201 to pivot and push the front slide arm 203 forward. Being attached to the front slide, the front slide arm 203 pushes the front slide forward in a direction substantially opposite the direction of the rear slide.

Figure 12:
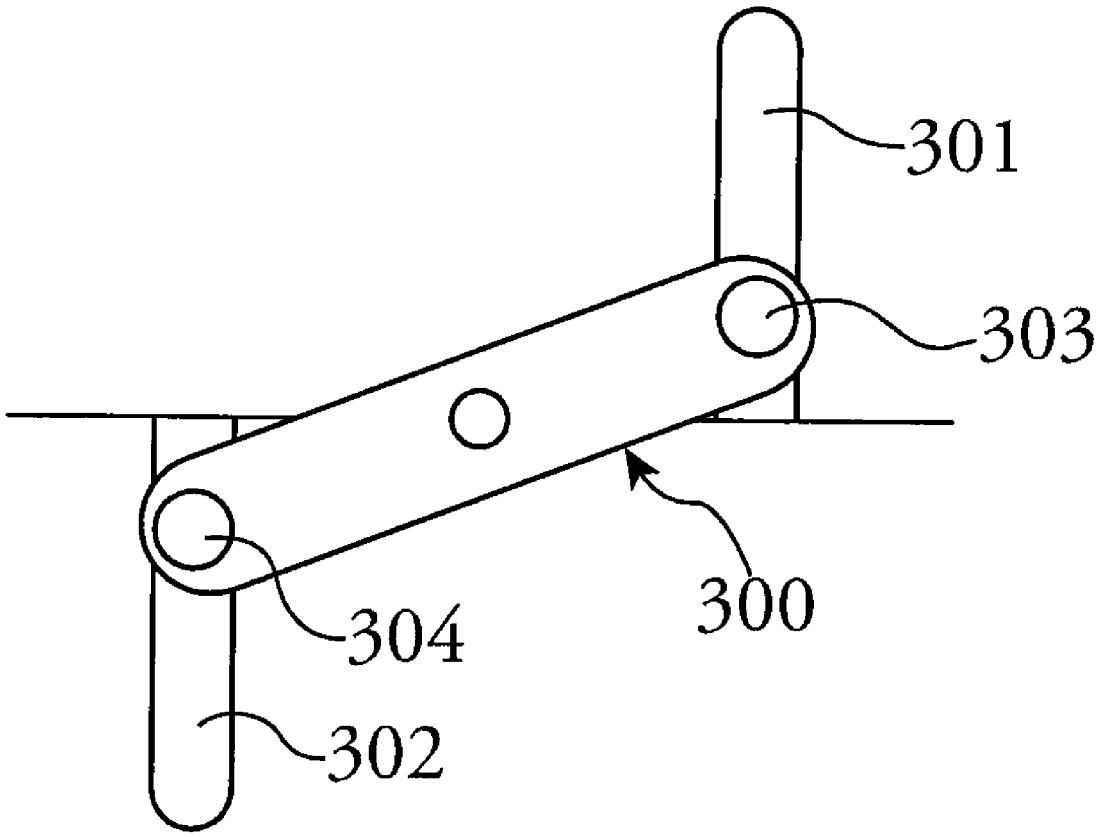
FIG. 12 is a schematic view of a slide arm at rest according to one embodiment.

Referring now to FIG. 12, there is shown yet another slide transfer mechanism according to another embodiment. The slide arm 300 is affixed to the frame or a pivot mount (not shown). The slide arm 300 having a front projection 303 and a rear projection 304 attached thereto. The front slide has a front slot 301 that forms a track for the front projection 303, and the rear slide has a rear slot 302 forming a track for the rear projection 304. As a round is fired and the rear slide moves backwards (relative to the direction of the fired round), the rear projection 304 is forced to follow the rear slot 302. This motion causes the slide arm 300 to rotate and the front projection 303 to move along the front track 301. This causes the front slide to move forward in a direction opposite that of the rear slide.

In another embodiment the handgun includes a thumbscrew adjustable back strap near the rear portion of the grip to accommodate varying individual grips. The thumbscrew allows adjustment of the size of the handle. Users with smaller or larger hands will appreciate the adjustability and find the grip to be more comfortable in their hand when properly adjusted.

In use, a round is loaded into the chamber 142. Pulling the trigger 105 engages the firing pin 136 which fires the round. Upon firing, the expanding gases force the rear slide to move reward, in a direction opposite to the fired round, and at the same pull the lower slide arm portion 157 to the rear. The slide arms 152 rotate along the slide arm pin 154 causing the upper slide arm portion 156 to move forward and push the front slide 120 forward. The momentum of the front slide 120 counteracts a portion of the momentum of the rear slide 130, thereby reducing the recoil felt by the user and reducing muzzle climb. Additionally, as the recoil spring is compressed between the two slides, each slide receives the same counter recoil force from the spring. As the two slides return to rest, they close above the axis of the hand, not behind, thereby further reducing muzzle climb. Also as the two slides move in opposite directions, each slide must only travel half the distance that that of a traditional slide.

In one embodiment the weight of the front slide is equal to the weight of the rear slide. In another embodiment the weight of the front slide is within 10% of the weight of the rear slide. In yet another embodiment the weight of the front slide is within 2% of the weight of the rear slide It is understood that the handgun as described can be converted from a right handed configuration to a left handed configuration by repositioning the extractor, ejector and magazine release accordingly. It is further understood that although a striker-type ignition system is shown. A system utilizing an external hammer is contemplated.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

PARTS LIST

10 prior art handgun
100 handgun
101 frame
102 casing ejector
103 safety
104 safety hole
105 trigger
106 frame rails
107 slide stop
108 cylindrical pivot bore
109 trigger guard
110 magazine
111 magazine well
112 magazine follower
113 magazine spring
120 front slide
121 front guide rails

122 guide rail stud
123 front recoil spring seat
124 barrel bore
125 front slide link insert
126 spring loaded detent
127 barrel stud insert
128 front sight
129 front guide rails
130 rear slide
131 rear slide rails
132 upper guide rails
133 rear recoil spring seat
134 extractor
135 rear slide link insert
136 firing pin
137 barrel recess
138 rear sight
139 front wall
140 barrel
141 muzzle end
142 chamber
143 barrel stud
144 notch
150 slide arm mount
151 spring hole
152 slide arm
153 slide arm hole
154 slide arm pin
155 shaft hole
156 upper slide arm portion
157 lower slide arm portion
160 recoil spring
200 slide arm extension
201 center arm
202 rear slide arm
203 front slide arm
300 slide arm
301 front slot
302 rear slot
303 front projection
304 rear projection
400 slide arm
401 receiving end
402 retainer slot
403 retainer spring
404 retainer spring
405 stud
501 stud
601 bearing surface
701 posts
801 keyed transfer sections
901 recoil spring housing
902 housing studs

The invention claimed is:

1. A dual slide firearm comprising:

a frame comprising frame rails;

a rear slide comprising rear slide rails attached to said frame rails and upper guide rails; and a front slide comprising guide rails attached to said upper guide rails and front slide rails attached to said frame rails;

a slide arm mount attached to said frame, said slide arm mount having an axis, and a slide arm, the slide arm having a lower slide arm portion in communication with said rear slide, and an upper slide arm portion in communication with said front slide;

wherein the firing of a projectile from said firearm results in the movement of said rear slide in a direction opposite the fired projectile, said rear slide pulling the lower slide arm portion causing the slide arm to rotate along said axis and said upper slide arm portion to move forward, pushing said front slide in the direction of the fired projectile.

2. The dual slide firearm of claim 1 further comprising a recoil chamber.

3. The dual slide firearm of claim 2 further comprising a recoil spring positioned within said recoil chamber.

4. The dual slide firearm of claim 3 where said recoil spring is in communication with said front slide and said rear slide.

5. The dual slide firearm of claim 1 said frame further comprising a cylindrical pivot bore for receiving a pivot mount pin.

6. The dual slide firearm of claim 5 where said slide arm mount comprising a first and second cylindrical bore, the first bore being aligned with said cylindrical pivot bore to receive a pivot mount pin, the pivot mount pin extending through said cylindrical pivot bore and said first bore to retain said slide arm mount in a fixed position relative to said frame.

7. The dual slide firearm of claim 1 wherein said front slide has a weight that is within 10% of the weight of said rear slide.

8. The dual slide firearm of claim 1 wherein said front slide has a weight that is within 2% of the weight of said rear slide.

9. The dual slide firearm of claim 1 further comprising a slide transfer mechanism in communication with said front slide and said rear slide.

10. The dual slide firearm of claim 9 wherein said slide transfer mechanism is a slide arm extension.

11. A recoil reduced handgun comprising:

a frame comprising handle portion and a top portion;

a front slide positioned above said top portion;

a rear slide positioned above said top portion, with at least a portion of said rear slide being positioned behind said front slide;

a slide arm mount attached to said frame, said slide arm mount having an axis, and a slide arm, the slide arm having a lower slide arm portion in communication with said rear slide, and an upper slide arm portion in communication with said front slide; and a chamber to house a projectile;

wherein upon firing the projectile results in a recoil of said front slide and said rear slide, the direction of the recoil of said front slide being substantially opposite to the direction of the recoil of said rear slide.

12. The recoil reduced handgun of claim 11 where said front slide has a weight that is within 2% of the weight of said rear slide.

13. The recoil reduced handgun of claim 11 further comprising a pivot link attached to said frame and in communication with said front slide and said rear slide, wherein upon firing the projectile the pivot link transfers recoil energy from said rear slide to said front slide.

14. The recoil reduced handgun of claim 11 further comprising a recoil spring in communication with said front slide and said rear slide, to return said front slide and said rear slide to their original resting positions.

15. The recoil reduced handgun of claim 11 further comprising a slide transfer mechanism in communication with said front slide and said rear slide.

16. A method for manufacturing a firearm comprising the steps of:

providing a frame comprising frame rails;

attaching a slide arm mount said frame, said slide arm mount having an axis, and a slide arm, the slide arm having a lower slide arm portion, and an upper slide arm portion;

attaching a rear slide to said frame rails and said lower slide arm portion, said rear slide comprising upper guide rails; and attaching a front slide to said upper guide rails and said upper slide arm portion, wherein the firing of a projectile from said firearm results in the movement of said rear slide in a direction opposite the fired projectile, said rear slide pulling the lower slide arm portion causing the slide arm to rotate along said axis and said upper slide arm portion to move forward, pushing said front slide in the direction of the fired projectile.

* * * * *